US006168439B1

(12) United States Patent
Anderson

(10) Patent No.: US 6,168,439 B1
(45) Date of Patent: Jan. 2, 2001

(54) WORD GAME

(76) Inventor: Fay Anderson, 10602 Inwood Ave., Silver Spring, MD (US) 20902

( * ) Notice: Under 35 U.S.C. 154(b), the term of this patent shall be extended for 0 days.

(21) Appl. No.: 09/383,682

(22) Filed: Aug. 26, 1999

(51) Int. Cl.[7] ..... G09B 1/00; G09B 19/00

(52) U.S. Cl. ..... 434/167; 434/258; 434/363; 273/299

(58) Field of Search ..... 434/167, 170, 434/258, 349, 363; 273/429, 430, 432, 440, 445, 446, 459, 299

(56) References Cited

U.S. PATENT DOCUMENTS

| | | | | |
|---|---|---|---|---|
| 2,128,749 | * | 8/1938 | Koch et al. . | |
| 4,923,199 | * | 5/1990 | Hahn | 273/299 |
| 5,207,435 | * | 5/1993 | Tanner | 273/429 |
| 5,230,518 | * | 7/1993 | Crowe et al. | 273/459 |
| 5,480,157 | * | 1/1996 | Plummer | 273/432 |
| 5,657,994 | * | 8/1997 | O'Connor | 273/299 |
| 5,788,238 | * | 8/1998 | LeBriton et al. | 273/272 |

* cited by examiner

*Primary Examiner*—Sam Rimell
*Assistant Examiner*—Bena B. Miller

(57) ABSTRACT

A word game for entertaining players and improving their vocabularies. The method of playing the word game comprises the steps of providing a plurality of tiles each with a front and a back. The front and back of each of the tiles has a unique letter of the alphabet imprinted thereon. A timer is provided. The timer expires after a predetermined amount of time has elapsed. A card is provided for each player, each having a plurality of columns and a series of rows. All players simultaneously participate. One player shakes all the tiles in a tumbler and lets one tile fall out. The front and the back of the tile are viewed and the timer is started. Players write two series of words on the card they are holding. Each of the series is written in a unique row of the card. Words in the first series begin with one of the letters of the tile. Words in the second series begin with the other of the letters of the tile. Each of the words written in the first of the columns is of one syllable. Words in consecutive columns increase by one syllable. A score of three points per word per syllable is assigned. The score of all words is summed to obtain a final score. The player having the highest final score is the winner.

7 Claims, 2 Drawing Sheets

16

| 1 | 2 | 3 | 4 | 5 | 6 |
|---|---|---|---|---|---|
| A | ARGUE | ARGUMENT | ARGUABLE | ARGUMENTATIVE | ARGUMENTATIVELY |
| | | | | | |
| | | | | | |
| | | | | | |
| | | | | | |
| | | | | | |
| | | | | | |
| | | | | | |
| | | | | | |
| | | | | | |
| | | | | | |
| | | | | | |
| | | | | | |
| | | | | | |
| | | | | | |

FIG. 4

WORD GAME

BACKGROUND OF THE INVENTION

1. Field of the Invention

The present invention relates to games and more particularly pertains to a new word game for entertaining players and improving their vocabularies.

2. Description of the Prior Art

The use of games is known in the prior art. More specifically, games heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,306,153; U.S. Pat. No. 3,654,712; U.S. Pat. No. 3,678,602; U.S. Pat. No. 4,014,548; U.S. Pat. No. 1,732,980; and U.S. Pat. No. Des. 359,049.

While these devices fulfill their respective, particular objectives and requirements, the aforementioned patents do not disclose a new word game. The method of playing the word game comprises the steps of providing a plurality of tiles each with a front and a back. The front and back of each of the tiles has a unique letter of the alphabet imprinted thereon. A timer is provided. The timer expires after a predetermined amount of time has elapsed. A card is provided for each player, each having a plurality of columns and a series of rows. All players simultaneously participate. One player shakes all the tiles in a tumbler and lets one tile fall out. The front and the back of the tile are viewed and the timer is started. Players write two series of words on the card they are holding. Each of the series is written in a unique row of the card. Words in the first series begin with one of the letters of the tile. Words in the second series begin with the other of the letters of the tile. Each of the words written in the first of the columns is of one syllable. Words in consecutive columns increase by one syllable. A score of three points per word per syllable is assigned. The score of all words is summed to obtain a final score. The player having the highest final score is the winner.

In these respects, the word game according to the present invention substantially departs from the conventional concepts and designs of the prior art, and in so doing provides an apparatus primarily developed for the purpose of entertaining players and improving their vocabularies.

SUMMARY OF THE INVENTION

In view of the foregoing disadvantages inherent in the known types of games now present in the prior art, the present invention provides a new word game construction wherein the same can be utilized for entertaining players and improving their vocabularies.

The general purpose of the present invention, which will be described subsequently in greater detail, is to provide a new word game apparatus and method which has many of the advantages of the games mentioned heretofore and many novel features that result in a new word game which is not anticipated, rendered obvious, suggested, or even implied by any of the prior art games, either alone or in any combination thereof.

To attain this, the method of playing the word game generally comprises a plurality of tiles each with a front and a back. The front and back of each of the tiles has a unique letter of the alphabet imprinted thereon. A timer is provided.

The timer expires after a predetermined amount of time has elapsed. A card is provided for each player, each having a plurality of columns and a series of rows.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new word game apparatus and method which has many of the advantages of the games mentioned heretofore and many novel features that result in a new word game which is not anticipated, rendered obvious, suggested, or even implied by any of the prior art games, either alone or in any combination thereof.

It is another object of the present invention to provide a new word game which may be easily and efficiently manufactured and marketed.

It is a further object of the present invention to provide a new word game which is of a durable and reliable construction.

An even further object of the present invention is to provide a new word game which is susceptible of a low cost of manufacture with regard to both materials and labor, and which accordingly is then susceptible of low prices of sale to the consuming public, thereby making such word game economically available to the buying public.

Still yet another object of the present invention is to provide a new word game which provides in the apparatuses and methods of the prior art some of the advantages thereof, while simultaneously overcoming some of the disadvantages normally associated therewith.

Still another object of the present invention is to provide a new word game for entertaining players and improving their vocabularies.

Yet another object of the present invention is to provide a new word game, the method of playing which includes the steps of providing a plurality of tiles each with a front and a back. The front and back of each of the tiles has a unique letter of the alphabet imprinted thereon. A timer is provided. The timer expires after a predetermined amount of time has elapsed. A card is provided for each player, each having a plurality of columns and a series of rows. All players simultaneously participate. One player shakes all the tiles in a tumbler and lets one tile fall out. The front and the back of the tile are viewed and the timer is started. Players write two series of words on the card they are holding. Each of the series is written in a unique row of the card. Words in the first series begin with one of the letters of the tile. Words in the second series begin with the other of the letters of the tile. Each of the words written in the first of the columns is of one syllable. Words in consecutive columns increase by one syllable. A score of three points per word per syllable is assigned. The score of all words is summed to obtain a final score. The player having the highest final score is the winner.

Still yet another object of the present invention is to provide a new word game that teaches players about words and syllables.

Even still another object of the present invention is to provide a new word game that hones a player's writing and letter recognition skills.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a schematic side view of a scorecard of the present invention.

DESCRIPTION OF THE PREFERRED EMBODIMENT

Figure 1:
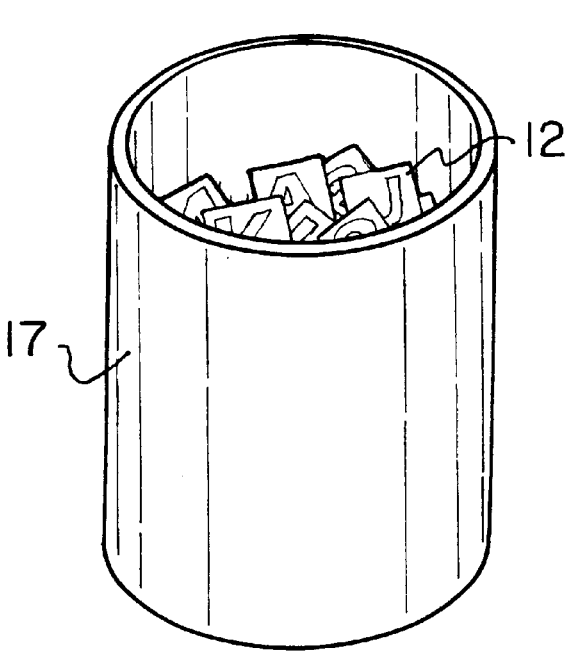
FIG. 1 is a schematic perspective view of a tumbler of a new word game according to the present invention.
Figure 2:
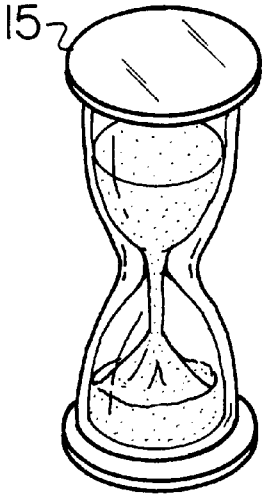
FIG. 2 is a schematic perspective view of a timer of the present invention.
Figure 3A:
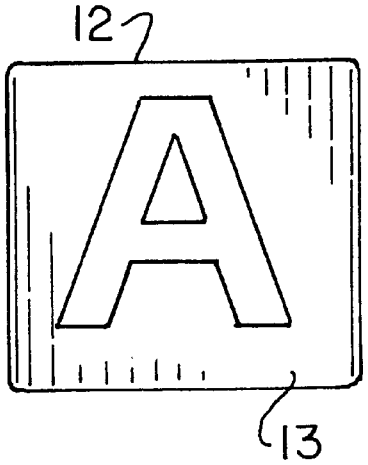
FIG. 3*a* is a schematic front view of a tile of the present invention.
Figure 3B:
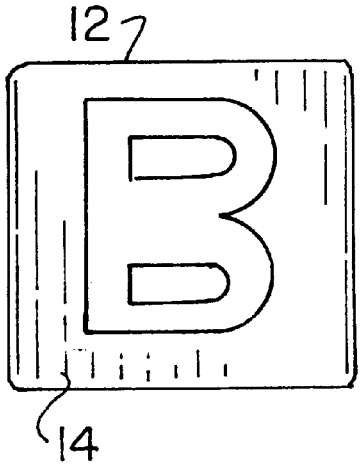
FIG. 3*b* is a schematic back view of a tile of the present invention.

With reference now to the drawings, and in particular to FIGS. 1 through 4 thereof, a new word game embodying the principles and concepts of the present invention and generally designated by the reference numeral 10 will be described.

As best illustrated in FIGS. 1 through 4, the method of playing a word game 10 generally comprises the steps of providing a plurality of tiles 12 each with a front 13 and a back 14. The front and back of each of the tiles has a unique letter of the alphabet imprinted thereon. A timer 15 is provided. The timer expires after a predetermined amount of time has elapsed. A card 16 is provided for each player, each having a plurality of columns and a series of rows. One person uses the tumbler to shake the tiles and allows a predetermined amount of tiles to fall out of the tumbler. All players look at the front and back sides of the tiles to view the letters on each side. The timer is started and all players begin writing two series of words on the card. Each of the series is written in a unique row of the card. Words in the first series of words begin with one of the letters of the tile. Words in the second series of words begin with the other of the letters of the tile. Each of the words written in a first of the columns is of one syllable. Words in consecutive columns increase by one syllable. A score of three points per word per syllable is assigned. The score of all words is summed to obtain a final score. The player having the highest final score is the winner.

Preferably, thirteen tiles are provided, each having a front and a back each having a unique letter of the alphabet imprinted thereon. For example, the front of one tile has an "A" and the back has a "B." The front of another tile has a "C" and the back has a "D" and so on.

Preferably, the timer is an hourglass type timer. Ideally, the timer expires after three minutes. This provides approximately a minute and a half per letter Also preferably, a tumbler 17 is provided that is adapted for receiving the tiles for shaking and dispensing the tiles. The tumbler is shaken to scramble the tiles.

Preferably, each of the cards has six columns and a series of rows. Ideally, each of the columns increases in width from a first column to a sixth column. Each of the words written in a first of the columns is of one syllable. Each of the words written in a second of the columns is of two syllables. Each of the words written in a third of the columns is of three syllables. Each of the words written in a fourth of the columns is of four syllables. Each of the words written in a fifth of the columns is of five syllables. Each of the words written in a sixth of the columns is of six syllables.

A score of three points per word per syllable is assigned to the player. Preferably, one point is deducted for each syllable repeated. Also preferably, one point per syllable is deducted from the final score for each word identical to a word written by another player. The player having the highest final score is declared the winner.

An exemplary series of words would be as follows.

a argue argument arguable argumentative argumentatively

The "a" receives three points. "Argue" receives six points. "Argument" receives seven points: nine minus two for repeated syllables. If another player has "argument," the total score for that word is four: nine minus two for repeated syllables minus three points per syllable for the repeated word.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a word game, comprising the steps of:

providing a plurality of players;

providing a plurality of tiles each having a front and a back, said front and back of each of said tiles having a unique letter of the alphabet imprinted thereon;

providing a timer expiring after a predetermined amount of time has elapsed;

providing a card for each player, each of said cards having a plurality of columns and a series of rows;

one player scrambles said tiles and allows one of said tiles to be selected;

all players simultaneously take a turn, comprising the steps of:

viewing said letters on said front and back of said tile;

starting said timer;

writing two series of words on said card, each of said series being written in an unique one of said rows of said card, words of a first of said series of words beginning with one of said letters of said tile, words of a second of said series of words beginning with the other of said letters of said tile, each of said words written in a first of said columns being of one syllable, words in consecutive columns increasing by one syllable;

assigning a score of three points per word per syllable; and summing the score of all words to obtain a final score; and declaring a winner, a player having the highest final score being the winner.

2. The word game of claim 1, wherein said timer expires after three minutes.

3. The word game of claim 1, wherein each of said cards has six columns, words of a first of said series of words beginning with one of said letters of said tile, words of a second of said series of words beginning with the other of said letters of said tile, each of said words written in a first of said columns being of one syllable, each of said words written in a second of said columns being of two syllables, each of said words written in a third of said columns being of three syllables, each of said words written in a fourth of said columns being of four syllables, each of said words written in a fifth of said columns being of five syllables, each of said words written in a sixth of said columns being of six syllables.

4. The word game of claim 1, further comprising the step of providing a tumbler adapted for receiving said tiles.

5. The word game of claim 1, wherein one point is deducted for each syllable repeated.

6. The word game of claim 1, further comprising the step of deducting one point per syllable from said final score for each word identical to a word written by another player.

7. A method of playing a word game, comprising the steps of:

providing a plurality of players;

providing thirteen tiles each having a front and a back, said front and back of each of said tiles having a unique letter of the alphabet imprinted thereon;

providing a timer expiring after a predetermined amount of time has elapsed;

wherein said timer expires after three minutes;

providing a tumbler adapted for receiving said tiles;

providing a card for each player, each of said cards having six columns and a series of rows, each of said columns increasing in width from a first column to a sixth column;

shaking said tumbler to scramble said tiles;

drawing a tile;

all players simultaneously taking a turn, comprising the steps of:

viewing said letters on said front and back of said tile;

starting said timer;

writing two series of words on said card, each of said series being written in an unique one of said rows of said card, words of a first of said series of words beginning with one of said letters of said tile, words of a second of said series of words beginning with the other of said letters of said tile, each of said words written in a first of said columns being of one syllable, each of said words written in a second of said columns being of two syllables, each of said words written in a third of said columns being of three syllables, each of said words written in a fourth of said columns being of four syllables, each of said words written in a fifth of said columns being of five syllables, each of said words written in a sixth of said columns being of six syllables;

assigning a score of three points per word per syllable;

wherein one point is deducted for each syllable repeated;

summing the score of all words to obtain a final score; and deducting one point per syllable from said final score for each word identical to a word written by another player; and declaring a winner, a player having the highest final score being the winner.

* * * * *